United States Patent [19]

Macke

[11] 3,938,799

[45] Feb. 17, 1976

[54] SIGNATURE ARRANGING DEVICE AND METHOD

[75] Inventor: Thomas F. Macke, Fort Lauderdale, Fla.

[73] Assignee: Hydrabind, Inc., Miami, Fla.

[22] Filed: Oct. 24, 1972

[21] Appl. No.: 299,819

[52] U.S. Cl. ..... 270/55; 270/58

[51] Int. Cl.[2] ..... B65H 5/30

[58] Field of Search ..... 270/53–57; 198/133; 271/94

[56] References Cited

UNITED STATES PATENTS

| | | | |
|---|---|---|---|
| 1,202,908 | 10/1916 | Slauson et al. | 270/55 |
| 2,815,949 | 12/1957 | Faeber | 271/64 |
| 2,895,730 | 7/1959 | Biel et al. | 270/53 X |
| 2,917,307 | 12/1959 | Biel | 270/53 X |
| 3,025,052 | 3/1962 | Gutteling | 271/94 |
| 3,383,103 | 5/1968 | Miller | 270/58 |
| 3,658,318 | 12/1971 | Bunting et al. | 270/55 |

FOREIGN PATENTS OR APPLICATIONS

| | | | |
|---|---|---|---|
| 93,481 | 7/1938 | Norway | 270/55 |
| 262,887 | 7/1911 | Germany | 270/57 |

*Primary Examiner*—Robert W. Michell
*Assistant Examiner*—V. Millin

[57] ABSTRACT

A device and method for arranging book signatures or single sheets of paper in an inside each other stacked or side-by-side array in which a single mechanism may be utilized for either operation, dependent upon the relative position of the signature backbone in the holder magazine. A single transfer is employed with a triangularly shaped saddle above the collating tray. If signatures are fed, backbone first, to the cylinder, the signatures will be collated side-by-side in the collating tray; if fed open face first, the signatures will be inserted and stacked inside of each other.

11 Claims, 16 Drawing Figures

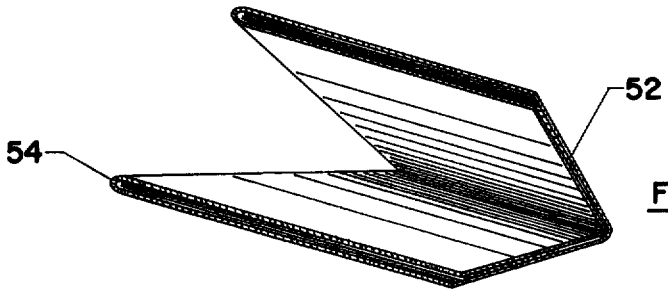
FIG. 2A
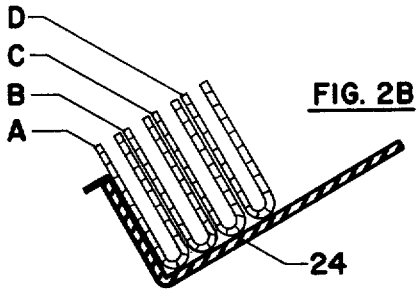
FIG. 2B
FIG. 2C
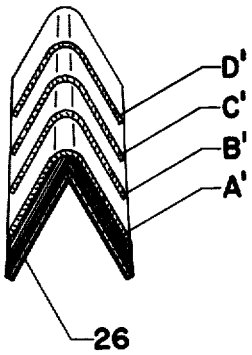

SIGNATURE ARRANGING DEVICE AND METHOD

BACKGROUND OF THE INVENTION

This invention relates generally to a signature inserting and collating device employed in a bookbinding operation, and specifically to a single device that can be utilized in providing either inserted into each other or side-by-side signature array.

In the past, two different machines were required for arranging signatures in two different arrays, one to insert them inside each other (inserting) and another for stacking one on top of the other (collating). Having different machines required more space, less flexibility and increased expense.

Applicant's invention provides a single device which can accomplish either operation utilizing a single transfer cylinder.

BRIEF DESCRIPTION OF THE INVENTION

A device for arranging and collating signatures or single sheets of paper in a bookbinding operation comprising a signature holder magazine, a transfer cylinder having a signature pickup means, a vacuum aperature coupled adjacent said magazine, a signature receiving means, and a linear, reciprocating pusher finger adjacent said receiving means, said finger adjustable relative to receiving means to a first position for moving inserted signatures in a first direction and to a second position for moving collated signatures in a second direction.

In operation, signatures are placed in the holding magazine with the signature backbone pointing toward the cylinder or away from the cylinder dependent upon the desired signature array, either collated or inserted.

A signature is defined as a sheet of paper folded in a predetermined pattern a number of times to achieve a number of pages of the following multiples: 2, 4, 8, 12, 16, 20, 24, 32, 36, 48, or 64.

For providing an inserted (one inside the other) signature array, signatures are removed from the holding magazine by a vacuum operated holding means located on the continuously rotating transfer cylinder surface, which rotates the signature to a predetermined point of cylinder travel. At that point, the vacuum is shut off, releasing the signature from the cylinder surface. Centrifugal force from rotation opens one side of the signature (the other side being held firmly to the cylinder surface) until vacuum cutoff. At cut-off, the signature is released and its forward momentum moves it into the top of a triangularly shaped saddle.

For the collated array, the signatures are stacked in the same holding magazine with the signature backbones adjacent the cylinder. The vacuum again holds the bottom signature in the magazine to the continuously rotating cylinder surface. A vacuum cut-off (at a predetermined point of cylinder travel), the signature is released (backbone downward), its forward momentum carrying it into a collating tray.

A plurality of transfer cylinders are disposed along a common shaft which provides rotational motion for all cylinders from a single motor. After a signature is received, either on the saddle apex or in the receiving tray, it is moved laterally to a position adjacent the next in line cylinder where another signature is deposited in a similar manner either inserted over or side-by-side to the previously deposited signature. Thus progressing in the direction of work flow from cylinder to cylinder, a stack of signatures in the desired array will be formed. After the last signature has been deposited at the end line cylinder, the signature array is then moved to the next binding operational stage such for stitching or glueing.

The work flow direction is dependent upon the particular signature array desired. The position of a reversible or removeable pusher finger determines the actual direction of work flow and allows for individual or split, simultaneous signature array operation.

In one embodiment, the receiving tray, saddle and a first pusher finger are constructed as a unit, so as to move as a unit. An attachable pusher finger is necessary with unitary construction to reverse the direction of work flow.

In an alternate embodiment, the saddle and receiving tray are stationary with a pair of moveable pusher fingers coupled adjacent the saddle to move the signature stacks to adjacent cylinders. In this embodiment, work flow direction is reversed by a 180° rotation of only one of the pusher fingers.

The motion in either embodiment, i.e. the unitary receiving tray, saddle and pusher finger or the pusher fingers relative to the stationary receiving tray and saddle, is reciprocal, moving back and forth between adjacent cylinders only.

It is an object of this invention to provide a single device which collates signatures and single sheets of paper or inserts signatures inside each other (inserting) for a bookbinding operation.

It is another object of this invention to provide a simplified machine which accomplishes assembling of folded sheets of paper into different arrays with a single device.

And yet another object of this invention is to provide a device with improved efficiency and economy for collating sheets of paper.

And still yet another object of this invention is to provide a multi-operational inserting and/or collating device utilizing a single drum with a vacuum pickup.

And yet still another object of this invention is to provide a dual purpose machine which collates folded sheets of paper both on top of each other or inserts them into each other either independently or simultaneously.

In accordance with these and other objects which will be apparent hereinafter, the instant invention will now be described with particular reference to the accompanying drawings.

BRIEF DESCRIPTION OF THE DRAWINGS

FIG. 2A shows a typical signature utilized with Applicant's invention.

FIGS. 2B and 2C shows different signature arrays produced by Applicant's invention.

PREFERRED EMBODIMENT OF THE INVENTION

Figure 1:
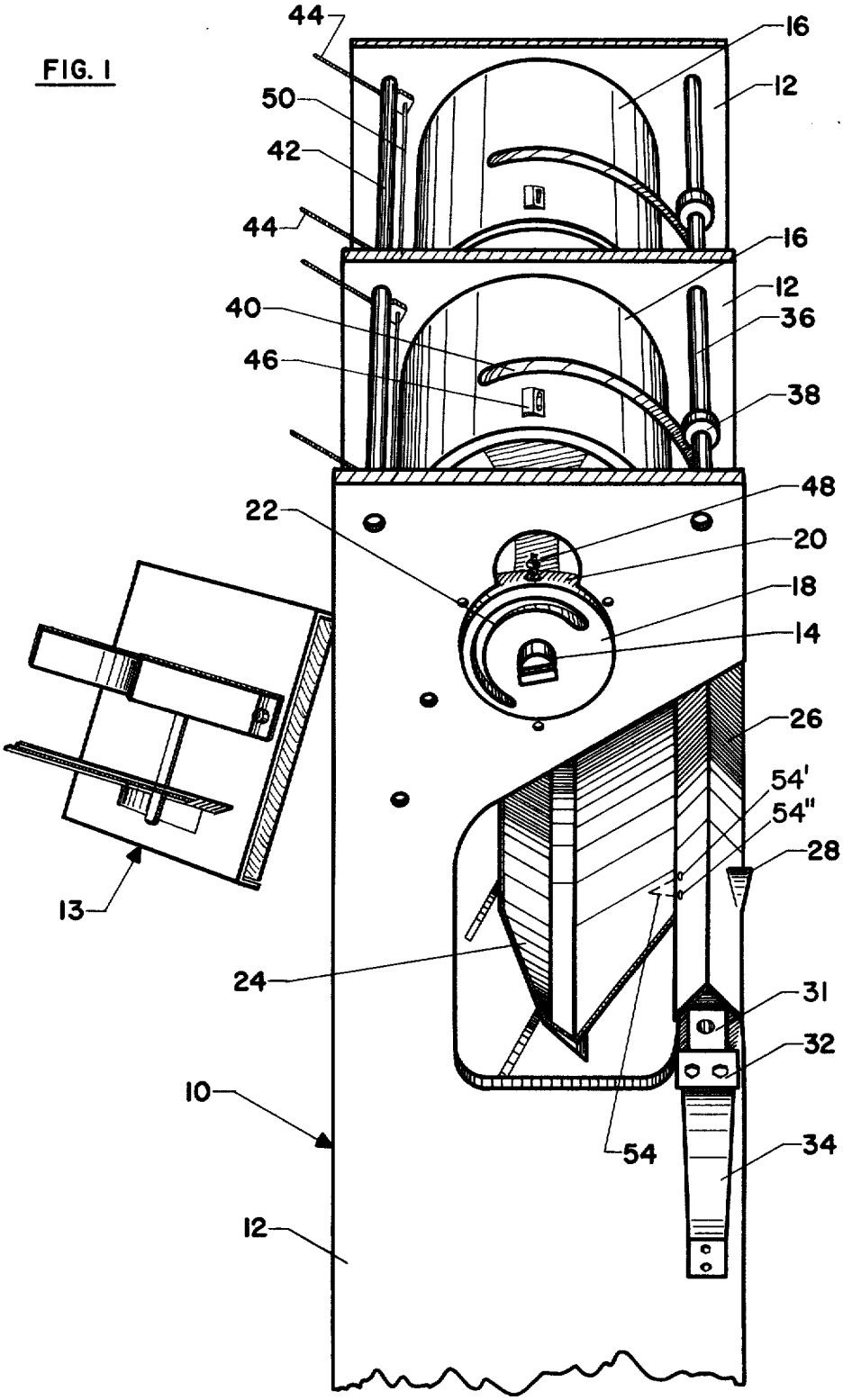
FIG. 1 is a perspective view of one embodiment of Applicant's invention with the holding magazine exploded away from the housing.

Referring now to the drawings, and in particular to FIG. 1, one embodiment of Applicant's invention is shown generally at 10 comprising a two drum device, the operation being the same at each drum. Any number of drums may be utilized dependent upon the number of different signatures to be inserted or collated.

The device is housed and supported by a plurality of rigid, vertical plates 12 connected together by top crossbars 36 and 40 and a plurality of bottom crossbars (not shown). Transfer drums 16 are rotatably mounted on a common shaft between adjacent support plates 12 within plate aperatures 20. Shaft 14 is coupled to a special bushing 18 having a vacuum mask chamber 22 and a vacuum inlet 48. The vacuum operation is explained below. A motor (not shown) drives common shaft 14, thus rotating drums 16 simultaneously. Additional drums may be connected along the common shaft as required.

Along one side, in line, a plurality of signature holding magazines 13 are coupled adjacent and facing drums 16. Signatures are stacked into the magazines 13 and are transferred individually, bottom first to the drum surface. The magazines 13 are adjustable in length and width to accommodate various sized signatures.

Coupled between the magazines 13 and the drum 16 are a plurality of air jet guide bars 50 supported by arms 44 connected to cross-bar 42. Air under pressure is forced out of small aperatures in bar 50 to separate like signatures to prevent the drum from picking up two signatures simultaneously.

A vacuum pick-up box 46 is mounted on each drum surface for pulling the signature from the magazine 13 and holding the signature to the drum surface during transfer.

Mounted on the opposite side and below the drums is the signature receiving tray 24 coupled adjacent to triangularly shaped saddle 26 which includes pusher finger 28 and pusher finger 54 illustrated by dotted lines and the adjacent connecting holes 54′ and 54′, the saddle and fingers moveably mounted on stationary support 31. Mounting bracket 34 couples support 31 to plate 12. The saddle 26 is driven by a motor (not shown) in linear, reciprocating motion, the distance before reversal being slightly greater than the distance between adjacent plates 12. A stripper 40 holds the signature adjacent the drum 16 during transfer.

FIG. 2A shows a typical eight page signature 52 which may be utilized in Applicant's invention, the backbone 54 being the final fold in a signature.

FIG. 2B shows four signatures A, B, C, and D stacked side-by-side one upon another (collated) achieved in one mode of operation of Applicant's invention.

FIG. 2C shows four signatures A′, B′, C′, and D′ inserted into each other (inserted) on saddle 26 achieved in an alternate mode of operation.

COLLATING MODE

Figure 3A:
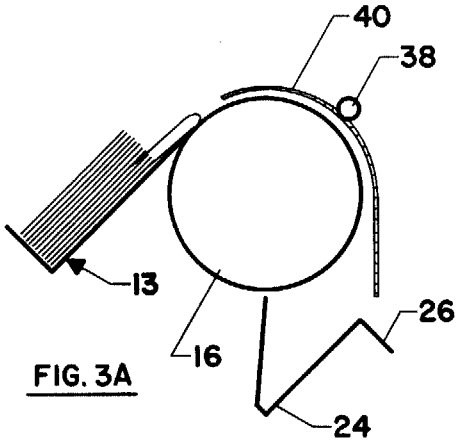
FIGS. 3A, 3B, and 3C shows schematically the operation of Applicant's invention for collating signatures in a receiving tray.
Figure 3B:
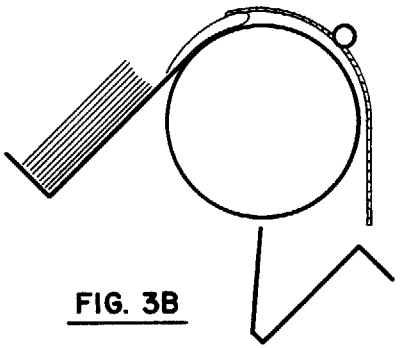

FIG. 3A shows the transfer cylinder 16 coupled to a signature so that a point on its surface is tangentially engaged with the bottom sheet of the signature stacked in the holding magazine 13. The bottom signature is held to the drum by a vacuum aperature and is rotated and taken from the magazine around the drum as it rotates. The signatures in the magazine are stacked with the backbones closer to and adjacent the drum.

Figure 3C:
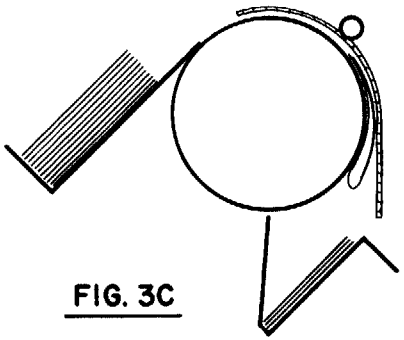

FIG. 3C shows the signature approximately 180° from its starting position at which point the vacuum holding the edge is released while the cylinder continues to rotate. At approximately the same moment another signature is removed from the bottom of the magazine and held by the cylinder. Once the vacuum on the cylinder aperature is released at the predetermined cylinder position, momentum will drive the signature down into the receiving tray 24, backbone first. The signature is then moved along to the next drum with others that have been previously positioned in the same way. Since the signature was positioned within the magazine with the backbone adjacent the cylinder, the entire signature will move into the tray as shown in FIG. 3C. A plurality of cylinders and receiving trays are disposed along a linear axis and each signature group is transferred with reciprocating motion in the receiving tray to the next stage or next cylinder. Another signature comes down and will be positioned adjacent the one previously deposited. Ultimately, at the end of the work line, the signatures will be stacked in a collated array, side-by-side, one on top of another as in FIG. 2B.

INSERTING MODE

Figure 4A:
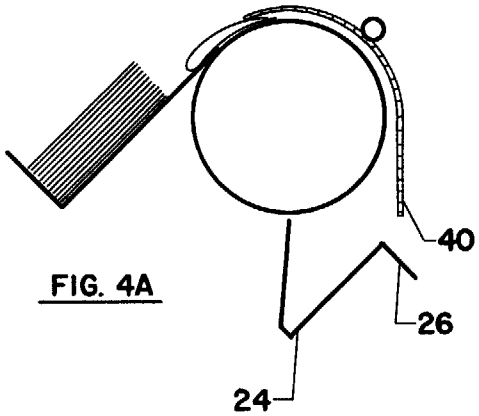
FIGS. 4A, 4B, and 4C shows schematically the operation of Applicant's invention for inserting signatures into each other and onto a saddle.
Figure 4B:
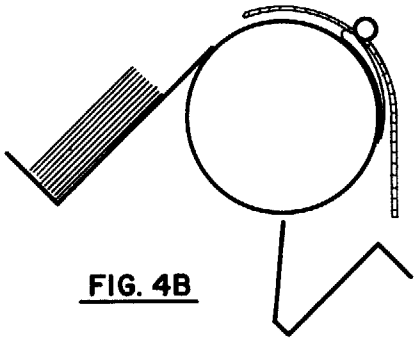
Figure 4C:
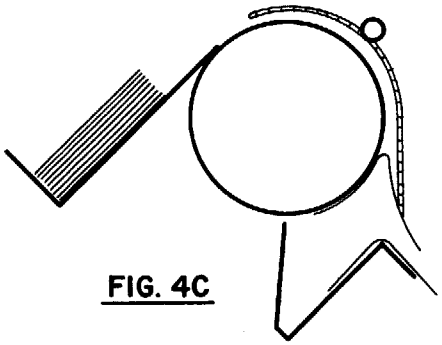

FIG. 4A shows the same device with the signatures arranged in the holding magazine 13 so that the signature face is toward the cylinder (backbone reversed from collating). The signature will be held to the cylinder as it is pulled out of the holding magazine as shown in FIG. 4A. FIG. 4C shows a signature with the open-face down and the signature edge at the predetermined rotation position of the drum whereby one side of folded pages are still coupled to the drum by the vacuum, while the other side will open due to the centrifugal force of rotation opening into a V-shaped signature. At a predetermined position, the vacuum is shut off which disengages the signature from the drum. Momentum drives the signature onto the saddle apex. Thus, the signature face straddles the saddle 26, the backbone being along the top of the saddle. In FIG. 4C, a signature is shown as it is about to leave the drum surface to be inserted upon a previously deposited different signature arriving from an adjacent transfer cylinder station. Thus, a plurality of signatures will be stacked inside each other and will be moved as a unit the requisite number have been stacked together where they will be removed at the end of the line for the next operation.

SIGNATURE ARRAY MOVEMENT

Figure 5:
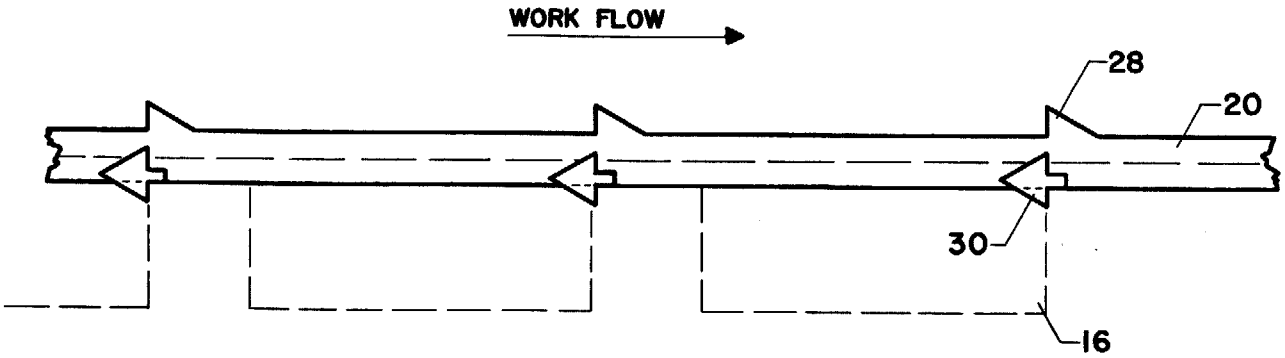
FIG. 5 shows a schematic of the transfer mechanism utilized in Applicant's invention.

FIG. 5 shows a plurality of cylinders disposed above the saddle and collating tray and the direction of work flow (collating) dependent upon the position of pusher finger 30. The fingers move in a reciprocating manner, linearly between adjacent transfer cylinders to move the work load (signature array) along to the next step. The tray in FIG. 5 receives signatures and provides for collating folded signatures one on top of the other utilizing one transfer cylinder only. With the position of pusher finger 30 pointed away from the direction of the work flow (with the protruding back portion), FIGS. 5 and 7B, as each signature is dropped into the tray and contacts pusher finger 30, motion of the finger to the right will move and slide the signatures along the tray until the finger reverses motion at the next cylinder. In the preferred embodiment (FIG. 1) the saddle 26 and pusher finger 54 (added for collating) move as a unit. In an alternate embodiment of that shown in FIGS. 5 and 6, the saddle remains stationary, with the pusher fingers moving the work. When motion of the finger is opposite the work flow, the finger, having a tapered portion, will slide under the signatures allowing the finger to return to the adjacent cylinder without moving any signatures in the direction away from work flow. A fixed stripper (in either embodiment) also prohibits backward motion of the work flow. Upon transferring of the next signature at each station, the procedure is repeated continuously.

Figure 6:
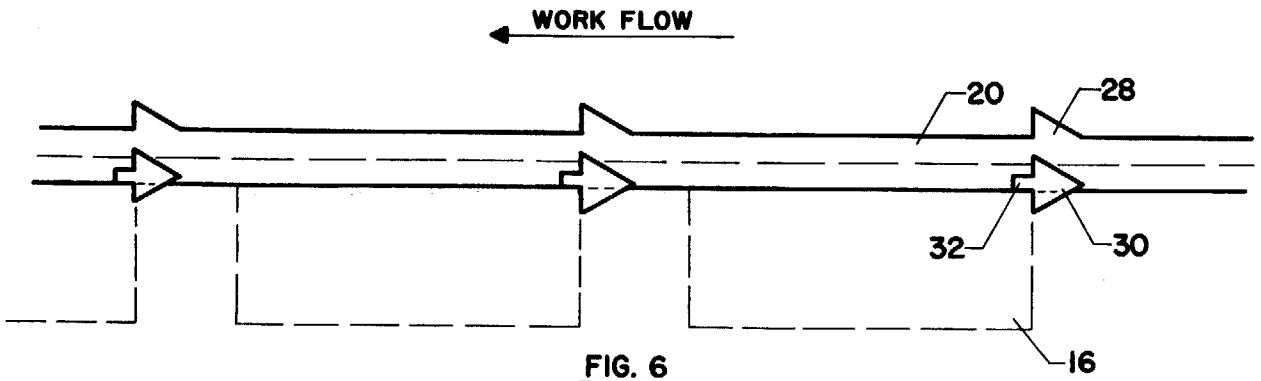
FIG. 6 shows a schematic of the transfer mechanism utilized in Applicant's invention is a different mode of operation than FIG. 5.
Figure 7A:
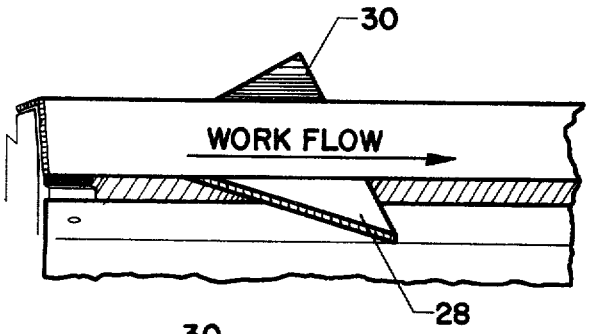
FIGS. 7A and 7B shows a partial view in perspective of a saddle and pusher fingers utilized in one embodiment of Applicant's invention.
Figure 7B:
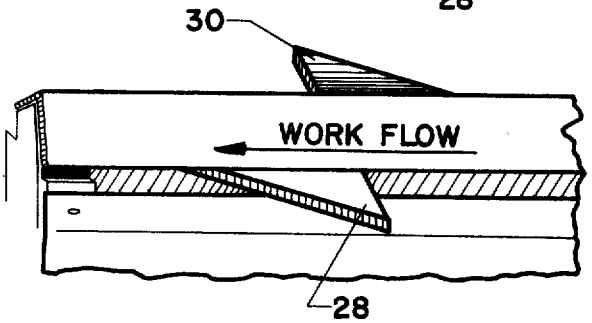
Figure 9:
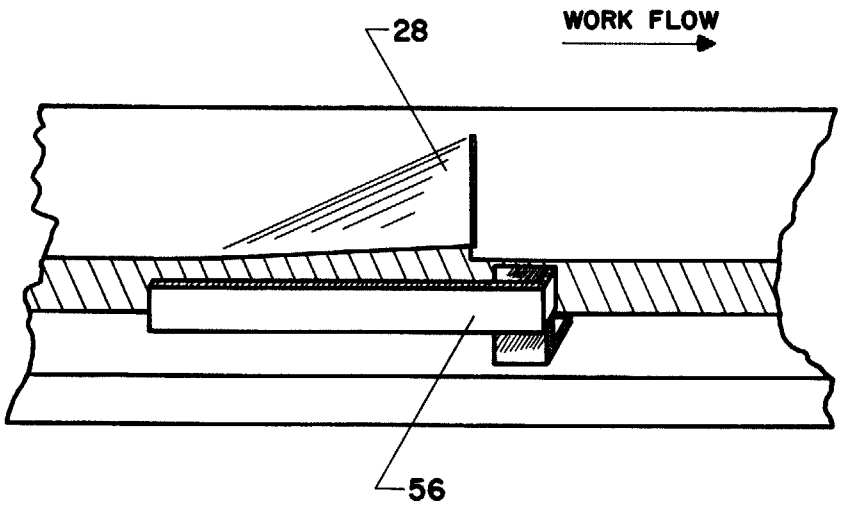
FIG. 9 shows an enlarged view of a jogger stripper utilized in one embodiment of Applicant's invention.

FIGS. 6 and 7A shows the same device (for inserting) with finger 30 rotated 180° and pointed again in the direction opposite the work flow. In this position the protruding back portion (which is perpendicular to the work flow direction) contact folded signatures resting on the saddle that are placed on top of and into each other and moves them to the left. Upon the reversal of motion of the fingers 28 and 30, the signatures will remain in their position by means of fixed strippers in front of the adjacent cylinder while the fingers return back to their former positions. In the preferred embodiment of FIG. 1, finger 54 is removed from holes 54' and 54''; the saddle and finger 28 move the inserted signatures. Fixed stripper 56 (FIG. 9) prevents backward motion of the signatures as the saddle and finger 28 return to a position in front of the adjacent cylinder.

Thus, in operation Applicant's invention can provide different signature stacking arrays with a single device by merely removing or rotating a pusher finger located on or adjacent the saddle. Also, either operation can be accomplished utilizing a single transfer drum.

Figure 8:
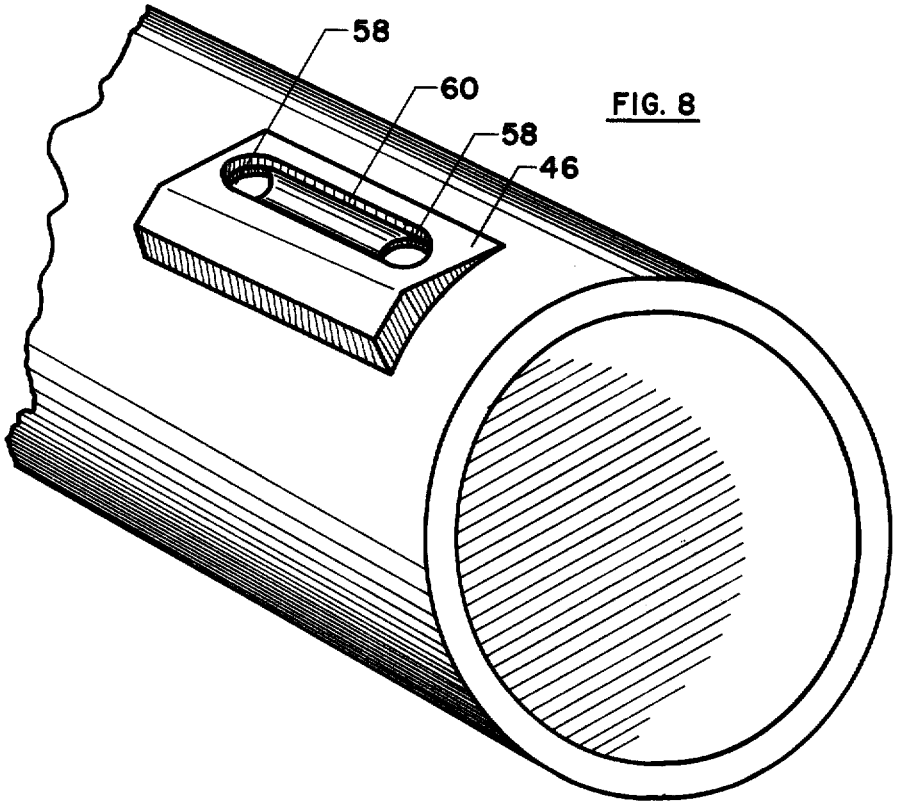
FIG. 8 shows a partial view in perspective of a transfer cylinder and vacuum aperture utilized in Applicant's invention.

FIG. 8 shows a transfer cylinder with a vacuum pickup box 46 with vacuum aperatures 58 through the cylinder surface connected to the vacuum surface. A channel 60 links the aperatures 58 along the surface. The pickup box 46 has an angled surface which contacts the bottom signatures surface in the holding magazine. The angle insures flush engagement between the signature and the pickup box.

A vacuum tube which rotates with the drum is connected to the aperatures 58 at one end and adjacent bushing 18 at the other end. As the tube end passes vacuum mask chamber 22 (FIG. 1) the vacuum will be on. The operation of the vacuum system is well known and any conventional system may be utilized.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A signature inserting and collating device utilized in a bookbinding operation for providing signatures stacked one inside the other in an inserted array or stacked side by side in a collated array comprising:

a magazine for holding a plurality of signatures in said magazine with backbone in a first position or in a second position, oppositely disposed;

a rotatable cylindrical drum having a surface signature connecting means connected tangentially at one point along its surface, said drum connected adjacent to said signature magazine and positioned to receive one edge portion of a signature in said magazine;

said signature connected means separates and holds a signature in said magazine to said cylindrical surface for a predetermined amount of rotational distance of said drum;

movable means coupled adjacent said cylinder for receiving said signatures from said drum surface in a first or second position in a receiving area relative to said magazine signature position;

signature drive means for driving said movable means for moving signatures; and finger means connected to said movable means, adjustable to a first position for moving signatures in a first direction and to a second position for moving signatures in an opposite direction.

2. A signature inserting and collating device utilized in a bookbinding operation for providing signatures stacked one inside the other in as inserted array or stacked side by side in a collated array, as set forth in claim 1, wherein, said movable means includes a collating tray coupled adjacent said drum, and a triangularly shaped saddle coupled adjacent and above said tray, said tray mounted to support signatures in a collated array and said saddle mounted to support signatures in an inserted array.

3. The method of arranging signatures in a predetermined array either collated signatures stacked side by side or inserted stacked one inside the other into each other comprising:

a. positioning at least one signature in a storage tray with the backbone in a first position adjacent a transfer cylinder or in a second position oppositely disposed away from said transfer cylinder;

b. transferring said signature to another means at a receiving area to a first location on said means for a collated signature array or to a second location on said means for an inserted signature array, the receipt of said signature into said first location or said second location dependent upon the position of the backbone in said storage tray.

4. The method of arranging signatures, as in claim 3, including the step of:

c. moving the signatures collected in said (receiving) means in either a first direction or the opposite direction.

5. In a signature arranging and transferring device having a storage tray, a rotatable transfer drum connected adjacent said storage tray for receiving signatures within said storage tray individually, a vacuum actuated signature attaching means for attaching said signature to said drum for a predetermined rational movement of said drum and receiving means positioned adjacent said transfer drum for receiving signatures from said drum, the improvement comprising:

said receiving means including a generally V-shapped saddle, a signature collecting tray disposed and connected to said saddle, said tray positioned adjacent said transfer cylinder for receiving signatures in a collated array of signatures stacked side by side, said saddle positioned to receive signatures in an inserted array of signatures stacked one inside the other said finger means moveable connected and positioned relative to said saddle and said tray for moving signatures in a first direction with said finger placed in a first position and moving signatures in the opposite direction with said finger placed in a second position, said signatures moveable in one direction along said saddle in an inserted array and movable in another direction along said tray in a collated array.

6. A device for providing a collated array of signatures stacked side by side or inserted array of signatures stacked one inside the other dependent upon the position of the backbone when first feed into the device comprising:

a storage tray;

means for transferring sigantures individually stacked in said storage tray; and a receiving means having a first portion for receiving signatures in an inserted array and a second portion for receiving signatures in a collated array, said transfer means including a means for depositing said signatures onto either said first portion of said receiving means of said second portion of said receiving means dependent upon the position of the backbone of the signature when disposed in the storage tray.

7. A device as set forth in claim 6 wherein;

said means for transferring is a single means.

8. A device as set forth in claim 7 wherein;

said single means is a drum.

9. A device for arranging signatures of folded sheets of material in at least two arrangements, one of which is an inserted array with one signature having a backbone placed inside another signature comprising;

a transfer means, a receiving means, and a magazine means for holding a plurality of stacked signatures in at least two positions, a first position with the signature backbone adjacent said transfer means, a second position oppositely disposed away from said transfer means with the open face of said signature adjacent said transfer means, said transfer means connected to and positioned adjacent said magazine means for receiving one of said signatures in either position adjacent a leading edge;

said transfer means including connecting means for connecting said signature to said transfer means, and for disengaging said connecting means to transfer said signature to said receiving means receives a signature in either of two positions, said transfer means shaped to allow said connecting means to deposit said signature in a first position at the receiving means when said signature is placed in said magazine means in the first position, and in a second position at the receiving means when said signature is placed in said magazine means in the second position.

10. A device for arranging signatures as set forth in claim 9 including, movable fingers connected to said receiving means for moving said signatures, said fingers movable into a first finger position and a second finger position to move said signatures in the first and second position respectively, and means for driving said transfer means and for driving said receiving means to move the two arrangements of signatures from the device.

11. A device for providing inserted array of signatures stacked on inside the other dependent upon the position of the backbone when first feeding into the device comprising:

a storage tray;

a means for transferring signatures individually stacked in said storage tray; and a receiving means having a portion for receiving signatures in an inserted array, said transfer means including a means for depositing said signatures onto said portion of said receiving means dependent upon the position of the backbone of the signature when disposed in the storage tray.

* * * * *